US006947523B2

(12) United States Patent
Güthlein et al.

(10) Patent No.: US 6,947,523 B2
(45) Date of Patent: Sep. 20, 2005

(54) X-RAY RADIATOR

(75) Inventors: Freddy Güthlein, Effeltrich (DE); Hermann Maier, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/784,059

(22) Filed: Feb. 20, 2004

(65) Prior Publication Data

US 2005/0185762 A1 Aug. 25, 2005

(51) Int. Cl.[7] ..... H01J 35/10

(52) U.S. Cl. ..... 378/130; 378/141; 378/200

(58) Field of Search ..... 378/119, 121, 130, 378/141, 143, 144, 193, 199, 200

(56) References Cited

U.S. PATENT DOCUMENTS 6,084,942 A * 7/2000 Hell et al. ..... 378/200
6,164,820 A * 12/2000 Hell et al. ..... 378/193
6,396,901 B1 * 5/2002 Hell et al. ..... 378/130
6,412,979 B1 * 7/2002 Hell et al. ..... 378/200
6,426,998 B1 * 7/2002 Hell et al. ..... 378/141

* cited by examiner

*Primary Examiner*—Edward J. Glick
*Assistant Examiner*—Courtney Thomas
(74) *Attorney, Agent, or Firm*—Schiff Hardin LLP

(57) ABSTRACT

A rotary bulb tube of an x-ray radiator is mounted for rotation in a housing, which is filled with a coolant and is connected to a shaft section, which in turn is connected by a coupling to a second shaft section extending to a motor for rotating the bulb tube. The coupling is designed to isolate the rotary bulb tube electrically from the motor and to isolate the bulb tube from motor vibrations.

16 Claims, 3 Drawing Sheets

X-RAY RADIATOR

BACKGROUND OF THE INVENTION

The present invention is directed to an X-ray Radiator in which a rotary bulb tube is rotatably accepted in a housing filled with a coolant and is connected with a shaft.

U.S. Pat. No. 6,396,901, whose disclosure is incorporated by reference thereto, discloses x-ray radiator which comprises a rotary piston tube or rotary bulb tube that is positioned for rotation in a housing filled with a coolant. The rotary bulb tube is driven by means of a motor that is mounted outside of the housing and is connected with the rotary bulb tube via a shaft directed into the housing. A dissipation or leakage of electrical potential occurs in an undesirable manner via the shaft which can impair the function of the motor. Aside from this, vibrations are sometimes transferred to the rotary bulb tube in an undesirable manner. Such vibrations will cause an x-ray beam emitted by the rotary bulb tube to move back and forth in response to these vibrations. Finally, the design known according to this prior art require a particularly high production precision in order to bring a shaft extending from the motor into exact alignment with the rotary bulb tube.

SUMMARY OF THE INVENTION

The object of the invention is to overcome these disadvantages that occur in the prior art. In particular, the object provides an x-ray radiator that can be produced as simply and cost-effectively as possible. Another goal of the invention is to prevent the dissipation or leakage of electrical potentials from the rotary bulb tube to the motor, as well as the transmission of vibrations therebetween. To accomplish these goals, the x-ray radiator comprises a rotary bulb tube that is mounted for rotation in a housing filled with a coolant and is connected by a shaft to the motor and the shaft is provided with a coupling.

According to the requirements of the invention, the coupling is engaged in the shaft. The inventive provision of the engaging of the coupling enables a simplified production. The housing can be prefabricated with the rotary bulb tube accommodated therein. The shaft section is extending from the motor can subsequently be simply connected to the rotary bulb tube by means of the coupling. In a suitable embodiment of the coupling a transference of potential to the motor and a transfer of vibrations from the motor to the rotary bulb tube can be prevented.

According to an advantageous embodiment, the coupling comprises an output disc that can be connected with a first shaft section extending from the rotary bulb tube, a drive disc that can be connected with a motor-side second shaft section, and an electrical insulating intermediate disc positioned to connect the output disc with the drive disc. Via this provision of the electrical insulating intermediate disc, the unwanted dissipation or leakage of electrical potential to the motor can be prevented.

The intermediate disc is appropriately manufactured from a plastic or ceramic. However, any other electrically insulating material which exhibits a sufficient mechanical durability for the present purpose is also usable. The output disc and/or drive disc is/are appropriately produced from metal.

To produce a non-positive connection between the drive disc and the intermediate disc, first projections extending from the drive disc and/or intermediate disc are engaged with first recesses, which are fashioned corresponding to the projections that are provided in the intermediate disc and/or the drive disc. It is likewise possible for production of the non-positive connection between the output disc and the intermediate disc, that second projections extend from the output disc and/or intermediate disc and are engaged in second recesses, which are fashioned corresponding to the projections, and are provided in either the intermediate disc and/or the output disc. The proposed embodiment enables a particularly simple assembly. In addition, by selecting a suitable embodiment of the recesses and the projections, slight deviations in the alignment of the first and second shafts sections, which are due to manufacturing tolerances can be compensated.

According to another additional advantageous embodiment, damping means are provided between the intermediate disc and the output disc and/or between the intermediate disc and the drive disc. These damping means can be elastic elements which are inserted into the recesses and lie in the radial direction on the sides of the projections engaged in the recesses.

The intermediate disc and the damping means are suitably produced from an oil-based resistant material. This increases the lifespan of the proposed x-ray radiator.

According to a further embodiment, the coupling is surrounded by a housing. In this case, the second shaft section is directed into a gap in the housing provided with a seal. The proposed design prevents electrical potentials to be dissipated or leaked in the region outside of the housing over the first shaft section extending from the rotary bulb tube.

Other advantages and features of the invention will be readily apparent from the following description, the claims and drawings.

DESCRIPTION OF THE PREFERRED EMBODIMENTS

Figure 1:
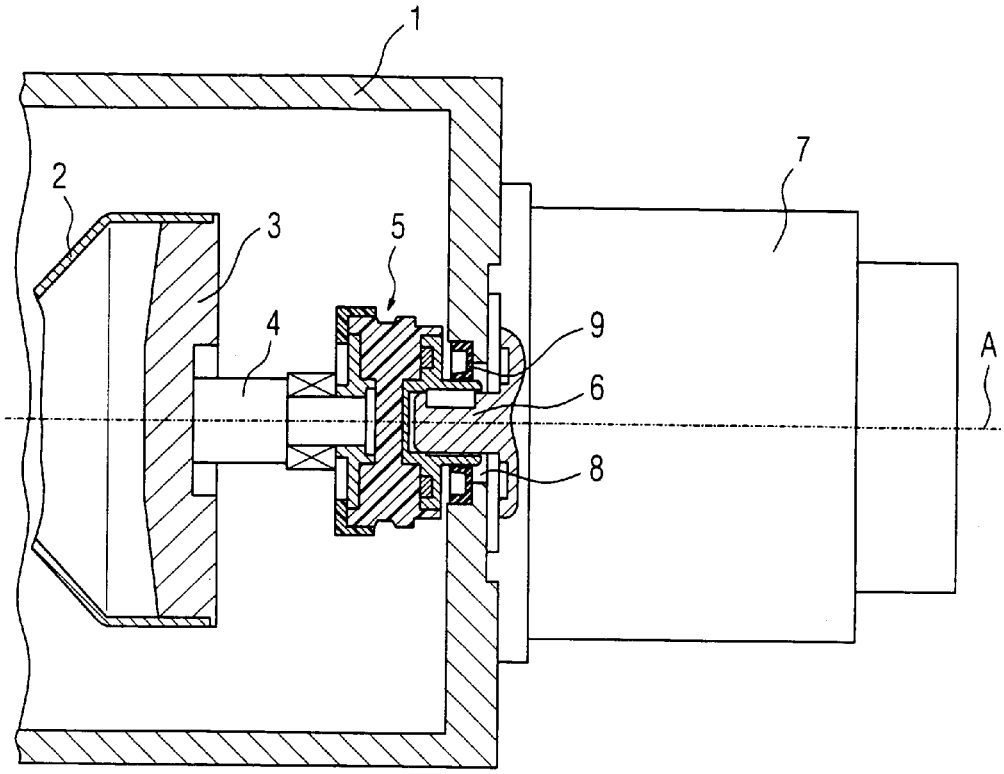
FIG. 1 is a partial cross sectional view through an x-ray radiator according to present invention.

The principles of the present invention are particularly useful when incorporated in an x-ray radiator which is shown in FIG. 1 and comprises a rotary bulb tube or piston tube 2 which is mounted in the housing 1 filled with a coolant so that it can be rotated around an axis A. A first shaft section 4, which extends from an anode plate 3 of the rotary bulb tube 2, is connected via a coupling, generally indicated at 5, with a second shaft section 6 which extends through a gap 8 provided in the housing 1 to a motor 7.

Figure 3:
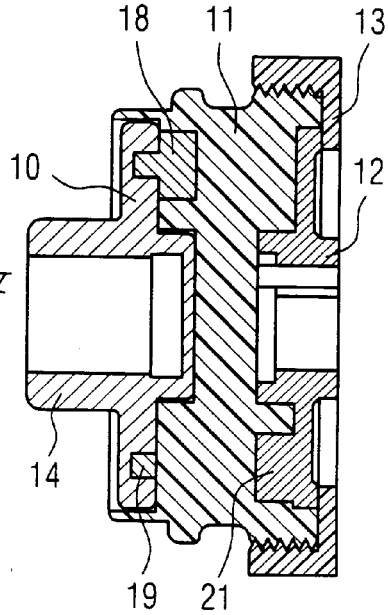
FIG. 3 is a cross sectional view of the coupling taken along line III—III of FIG. 2.
Figure 4:
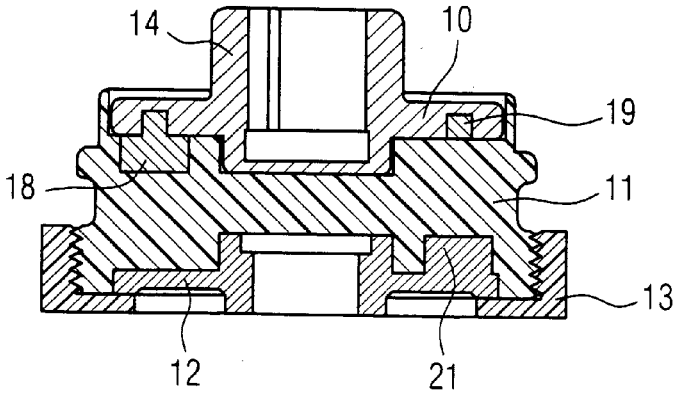
FIG. 4 is a cross sectional view of the coupling taken along line IV—IV of FIG. 2.

As illustrated in FIGS. 1 through 4, coupling 5 include a drive disc 10 which will be connected to the second shaft section 6. The drive disc 10 is engaged with an intermediate disc 11 which is produced from an electrically insulating substance. The intermediary disc 11 is in turn engaged with an output disc 12 that is connected to the first shaft section 4. The output disc 12 is secured to the intermediate disc 11 by a hasp bushing 13, which, as illustrated in FIG. 3, is threaded onto the intermediate disc 11.

Figure 5:
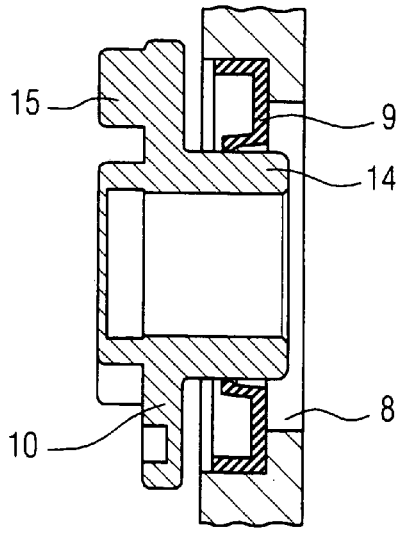
FIG. 5 is an enlarged cross sectional view of a portion of the coupling mounted in the housing of FIG. 1.
Figure 2:
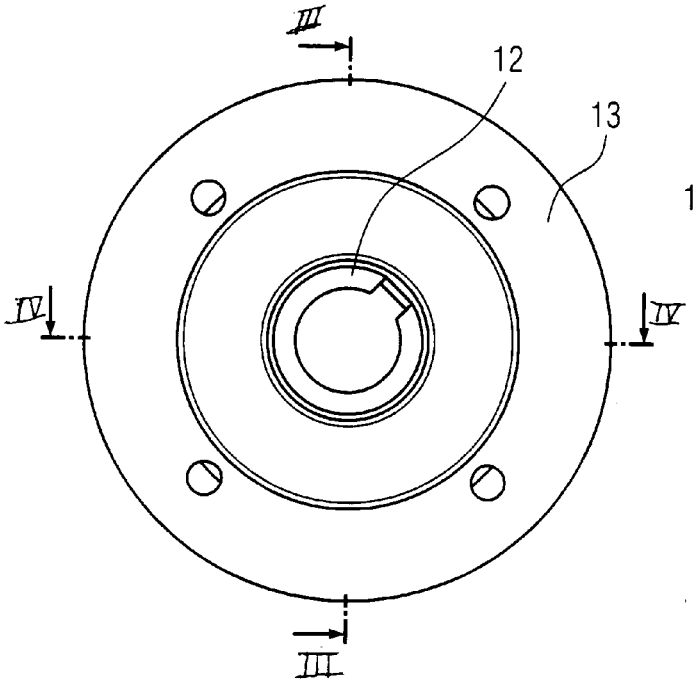
FIG. 2 is a plan view of a coupling for the x-ray radiator of FIG. 1.
Figure 6:
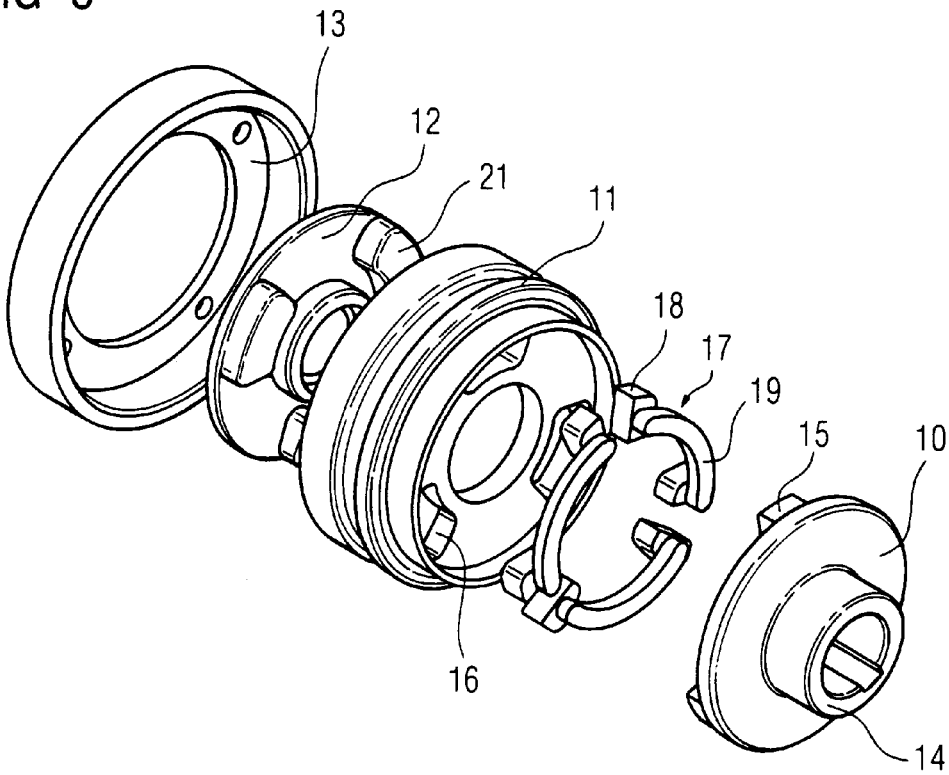
FIG. 6 is an exploded perspective view of the coupling taken from the right side of FIG. 1.
Figure 7:
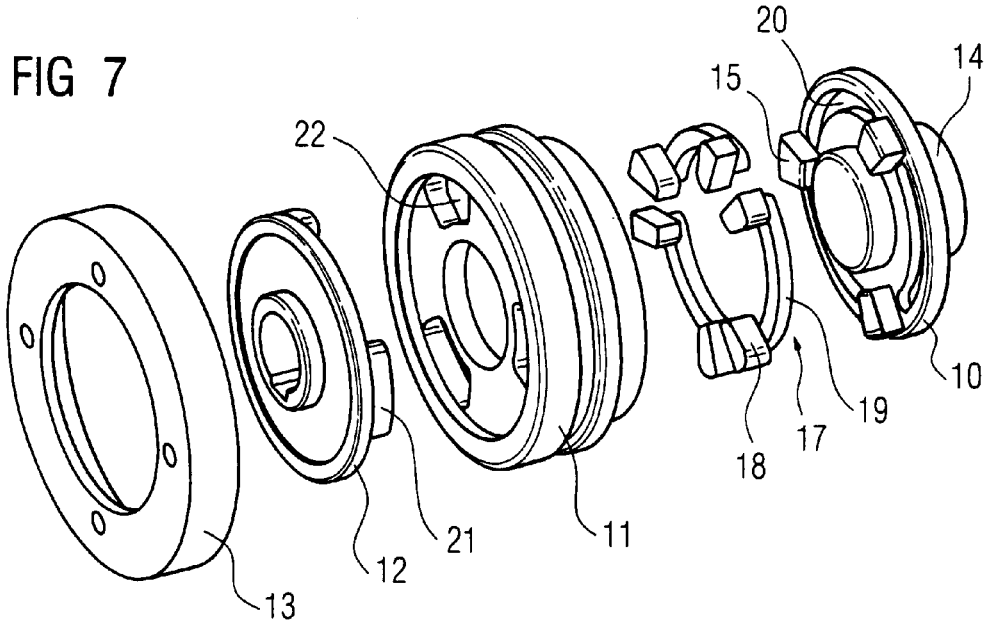
FIG. 7 is an exploded perspective view of the coupling taken from the left side of FIG. 1.

As shown in FIG. 5 the drive disc 10 has a hub portion 14 which extends into the gap 8 of housing 1. The hub or connecting piece 14 is fashioned as a hollow shaft section. A shaft ring seal 9 surrounds this hub or shaft section so that the fluid accepted within the housing cannot escape through the gap 8. The coupling 5 is shown again in FIGS. 6 and 7 in exploded views. The drive disc 10 has first projections 15 which extend from a side opposite the hub 14. These first projections 15 are received in first recesses 16 which are provided in the intermediate piece 11. Damping elements appropriately produced from an elastomer such as NBR (acryInitrile-butadiene-rubber), FKM (fluorine rubber) or the like, are respectively composed of two damping insets, pads or linings 18 that are connected with one another via an arch-like bridge or arcuate bridge 19. The bridge 19 is fashioned so that it can be used in a correspondingly curved or arcuate recess 20 which is formed in the back surface of the disc 10 to extend between adjacent first projections 15. As illustrated in the assembled state, the damping inserts 18 lie radially on the sides of the first projections 15 and can be mutually inserted together with the first projections into the first recesses 16.

The output disc 12 has second projection is 21. The second projections 21 are received in second recesses 22, which are formed in the intermediate disc 11.

The function of the coupling is as follows:

The drive disc 10 engaged with the first projections as well as the damping inserts 18 in the first recesses 16 of the intermediate disc 11. The second projections 21 extend from the output disc 12 and are engaged in the second recesses 22 which are provided on the other side of the intermediate disc 11. The output disc 12 is attached to the intermediate disc 11 by means of a hasp bushing 13.

A torque transferred from the second shaft section 6 or, respectively, the motor shaft to the drive disc 10 is dampened by means of the dampening elements 18. The intermediate disc 11 which is produced from an electrically insulating synthetic, for example PEEK (polyether-ether-ketone), PSU (polysulfone), PES (polyethersulfone), or from ceramics, for example aluminum oxide or the like prevents the dissipation or leakage of potential or current through the coupling 5.

With a suitable fashioning of the projections 15, 21, the dampening elements 18 and the recesses 16, 22, a slight axial and radial deviation in the alignment of the first shaft section 4 to the second shaft section 6 can also be compensated.

Although various minor modifications may be suggested by those versed in the art, it should be understood that we wish to embody within the scope of the patent granted hereon all such modifications as reasonably and properly come within the scope of our contribution to the art.

We claim:

1. An x-ray radiator having a rotary bulb tube mounted for rotation in a housing filled with a coolant, said rotary bulb tube being connected by a shaft arrangement having a coupling to a means for rotating the bulb tube, said means including a motor and the coupling forming a non-positive connection between the motor and the tube.

2. An x-ray radiator according to claim 1, wherein the coupling comprises output disc being connected with a first shaft section extending from the rotary bulb tube, a drive disc being connected to a second shaft section extending from the motor and an electrically insulating intermediate disc connecting the output disc with the drive disc.

3. An x-ray radiator according to claim 2, where in the intermediate disc is produced from a material selected from plastic and ceramic.

4. An x-ray radiator according to claim 2, wherein the output disc and the drive disc are formed of a metal.

5. An x-ray radiator according to claim 2, wherein the intermediate disc has a non-positive connection with each of the output disc and the drive disc, the drive disc has first projections extending therefrom and the intermediate disc has first recesses designed to receive the first projections to form the non-positive connection therebetween, said output disc having second projections and said intermediate disc on a side opposite the side having the first recesses having second recesses fashioned to receive the second projections to form an non-positive connection between the output disc and the intermediate disc.

6. An x-ray radiator according to claim 5, wherein the drive disc include damping means in the form of pads held on the sides of each first projection and being received in the first recesses of the intermediate disc.

7. An x-ray radiator according to claim 6, wherein the damping pad on one side of the first projection is connected by an arcuate bridge received in an arcuate recess in the drive disc to a damping pad of an adjacent first projection.

8. An x-ray radiator according to claim 2, wherein the second shaft section is directed through a gap in housing and provided with a seal.

9. An x-ray radiator according to claim 8, wherein the seal engages a hub portion of a drive disc of the coupling.

10. An x-ray radiator according to claim 1, wherein the coupling is surrounded by the housing.

11. An x-ray radiator according to claim 1, wherein the rotary bulb tube includes an anode plate, a first shaft section extending from an external side of the anode plate facing the inside of the housing.

12. An x-ray radiator having a bulb tube mounted for rotation in a housing filled with a coolant, means for rotating the bulb tube including a motor, a shaft arrangement including a first shaft section extending from the rotary bulb connected by a coupling to a second shaft section extending from the motor, said coupling having an output disc being connected with the first shaft section, a drive disc being connected to the second shaft section and an electrically insulating intermediate disc connecting the output disc with the drive disc, a coupling having a non-positive connection between the drive disc and the intermediate disc, said non-positive connection including first projections being received in first recesses, one of the intermediate disc and drive disc having the first projections and the recesses being positioned in the other of said discs.

13. An x-ray radiator according to claim 12, which includes damping means being engaged between the intermediate disc and the drive disc.

14. An x-ray radiator according to claim 13, wherein the damping means includes pads mounted in one of the drive disc and intermediate disc and engaging sides of each first projection, said pads and first projection being received in said first recess.

15. An x-ray radiator according to claim 13, wherein the intermediate disc and the damping means are produced from oil resistant materials.

16. An x-ray radiator having a rotary bulb tube mounted for rotation in a housing filled with a coolant, means for rotating the bulb tube including a motor, a shaft arrangement having a coupling for interconnecting the bulb tube to said motor, said coupling comprising an output disc being connected to a first shaft section extending from the rotary bulb, a drive disc being connected to a second shaft section extending from the motor and an electrically insulating intermediate disc connecting the output disc with the drive disc, said coupling having a non-positive connection between the output disc and the intermediate disc comprising second projections being received in second recesses, said second projections being provided on a selected one of the output disc and intermediate disc and the recesses being disposed in the other of said discs.

* * * * *